US012729851B2

(12) United States Patent
He et al.

(10) Patent No.: US 12,729,851 B2
(45) Date of Patent: Sep. 8, 2026

(54) DUAL FUEL VALVE

(71) Applicant: GDA Valve Technology Co., Ltd., Zongshan (CN)

(72) Inventors: Jingshou He, Zongshan (CN); Guanxing He, Zongshan (CN); Wei Zhao, Zongshan (CN)

(73) Assignee: GDA Valve Technology Co., Ltd., Zongshan (CN)

( * ) Notice: Subject to any disclaimer, the term of this patent is extended or adjusted under 35 U.S.C. 154(b) by 350 days.

(21) Appl. No.: 18/536,403

(22) Filed: Dec. 12, 2023

(65) Prior Publication Data

US 2025/0180205 A1 Jun. 5, 2025

(30) Foreign Application Priority Data

Dec. 1, 2023 (CN) ..... 202311644425.1

(51) Int. Cl.
*F23D 17/00* (2006.01)
*F23K 5/00* (2006.01)
*F23N 1/00* (2006.01)

(52) U.S. Cl.
CPC ..... *F23D 17/002* (2013.01); *F23K 5/00* (2013.01); *F23N 1/002* (2013.01); *F23D 2204/10* (2013.01); *F23N 2229/00* (2020.01)

(58) Field of Classification Search
None
See application file for complete search history.

(56) References Cited

U.S. PATENT DOCUMENTS 2,804,919 A * 9/1957 Kinnison ..... F23D 14/60 431/2
6,162,048 A * 12/2000 Griffioen ..... F23D 14/04 431/354
2012/0145693 A1* 6/2012 Deng ..... F24H 3/0417 219/201
2012/0255536 A1* 10/2012 Deng ..... F23D 14/64 251/231
2014/0248571 A1* 9/2014 Deng ..... A47J 37/0713 431/280
2014/0272741 A1* 9/2014 Downing ..... F23D 14/10 431/280
2015/0338100 A1* 11/2015 Deng ..... F23N 5/102 431/59
2018/0058692 A1* 3/2018 He ..... F23K 5/14
2018/0266679 A1* 9/2018 Pablo Curto ..... F23D 99/004

* cited by examiner

*Primary Examiner* — Jorge A Pereiro
(74) *Attorney, Agent, or Firm* — Polsinelli PC

(57) ABSTRACT

Disclosed is an electronic control system connected to a gas judgment assembly with an oxygen depletion sensor assembly and a sensor such as an ion induction needle to determine whether a flame is present. The gas judgment assembly includes a nozzle associated with the oxygen depletion sensor assembly that is large enough to permit a flame if the fuel is liquid propane, but small enough to prevent a flame if the fuel is natural gas, and send a signal indicating a flame or no flame status to the control system. The control system can thereafter determine whether a flame is present and, if so, conclude that liquid propane fuel is being directed to the gas judgment assembly while the system is in the natural gas mode. The control system can then open a relay, disconnecting current flow to a solenoid valve if a flame is sensed.

20 Claims, 6 Drawing Sheets

DUAL FUEL VALVE

TECHNICAL FIELD OF THE INVENTION

The present technology relates to dual fuel valves. In particular, the present technology relates to dual fuel valves designed to prevent combustion of fuel when the wrong fuel is selected at the selector valve.

BACKGROUND

Dual fuel devices are prevalent across many industries. These devices allow the use of two different fuels to provide combustion to the tool. For example, some heaters allow for the use of either liquid propane or natural gas due to the wide availability of both fuels. By providing one device that uses either fuel, inventory can be reduced significantly by avoiding the need for two separate devices, one for each fuel.

Dual fuel devices carry safety concerns due to the different pressures and orifice sizes for liquid propane and natural gas. Liquid propane is emitted at a higher pressure and flows through a smaller orifice, whereas natural gas is emitted at a lower pressure through a larger orifice. A device can become dangerous if the user selects natural gas (with the larger orifice) but delivers liquid propane to the device (with the higher pressure). High pressure gas through a large orifice leads to a high emittance of fuel and a correspondingly large risk of explosion.

BRIEF DESCRIPTION OF THE SEVERAL VIEWS OF THE DRAWINGS

The present technology will be described with reference to the appended drawings. The drawings aid in the description of the present technology and are not to be considered to be limiting the scope of the appended claims. The accompanying drawings include:

DETAILED DESCRIPTION

Figure 1:
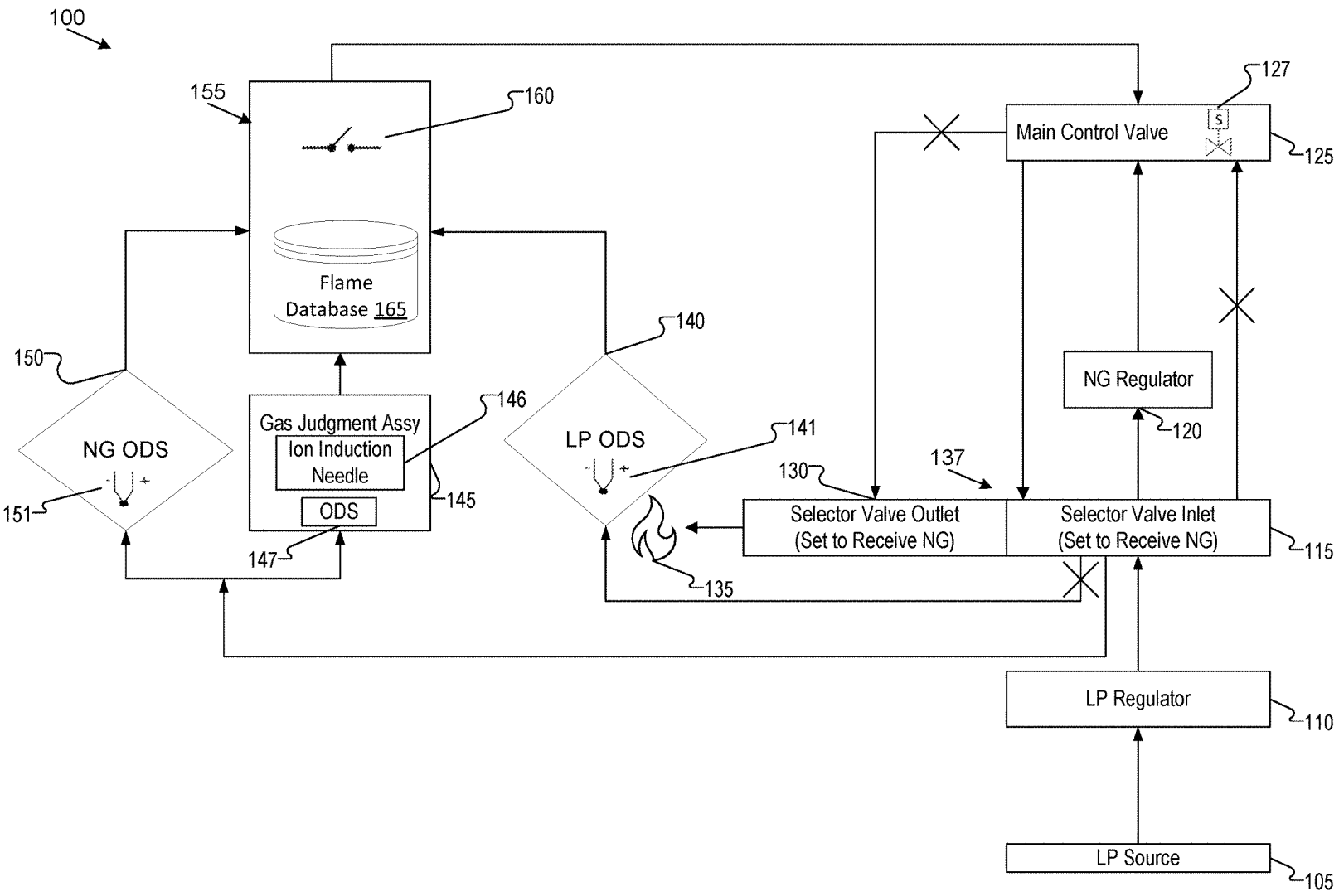
FIG. 1 illustrates a schematic representation of one of the presently disclosed embodiments with the selector valve in the natural gas setting, and liquid propane fed into the system.

Various embodiments of the disclosure are discussed in detail below. While specific implementations are discussed, it should be understood that this is done for illustration purposes only. A person skilled in the relevant art will recognize that other components and configurations may be used without parting from the spirit and scope of the disclosure.

Additional features and advantages of the disclosure will be set forth in the description which follows, and in part will be obvious from the description, or can be learned by practice of the herein disclosed principles. The features and advantages of the disclosure can be realized and obtained by means of the instruments and combinations particularly pointed out in the appended claims. These and other features of the disclosure will become more fully apparent from the following description and appended claims or can be learned by the practice of the principles set forth herein.

The present technology aims to solve the problem of the incorrect gas being selected at a selector valve of a dual fuel device. When liquid propane is fed into a natural gas system, the high pressure (compared to natural gas) liquid propane flows through a larger orifice (as compared to the smaller orifice intended for liquid propane). This provides an overabundance of fuel and a risk of explosion when the fuel is combusted.

The present technology addresses the above problem in several ways. First, the present technology incorporates an electronic control system connected to a gas judgment assembly with an oxygen depletion sensor assembly and an ion induction needle to provide an electromechanical device for determining whether the appropriate gas is being fed into the system. This electromechanical device is utilized while the valve is in the natural gas mode which, again, is the mode most likely to cause danger if the wrong fuel is applied. Here, the ion induction needle senses whether there is a flame present and provides a signal to the control system. The oxygen depletion sensor assembly includes a nozzle that is large enough to permit a flame if the fuel is liquid propane, but small enough to prevent a flame if the fuel is natural gas. The control system can thereafter determine whether a flame is present and, if so, conclude that liquid propane fuel is being directed to the gas judgment assembly while the system as a whole is in the natural gas mode. The control system can then disconnect the solenoid valve if a flame is sensed, thereby disconnecting a current provided to the solenoid valve and preventing the solenoid valve from opening; or take no action if a flame is not sensed, allowing the solenoid valve to remain electrically connected and modulated based on the current provided by the thermocouple associated with the selected fuel's pilot and oxygen depletion sensor.

The present technology also can use one inlet for both liquid propane and natural gas fuel sources. This inlet can provide the liquid propane regulator upstream from the natural gas regulator. Accordingly, the regulator with high inlet pressure is placed in front of the regulator with low inlet pressure to avoid multiple inlets. By doing so, the user cannot choose the wrong inlet for the fuel because there is only one inlet to choose from.

FIG. 1 illustrates a schematic representation of one of the presently disclosed embodiments with the selector valve in the natural gas setting, and liquid propane fed into the system. As shown, a liquid propane/natural gas system 100 is shown with a liquid propane source 105, such as a propane tank or related housing for liquid propane fuel. The liquid propane source 105 feeds into a liquid propane regulator 110, then passes the fuel through a selector valve inlet 115 and then through a natural gas regulator 120 due to the selector valve being erroneously placed in the natural gas mode. By providing two inline regulators, the system 100 only includes one inlet that feeds through both the liquid propane regulator 110 and the natural gas regulator 120 before reaching a main control valve 125.

Reducing the number of inlets to a single inlet provides many advantages over prior art systems with multiple inlets, one for each fuel source. For example, the regulator with high inlet pressure (liquid propane) is placed in front of the regulator with low inlet pressure (natural gas) to avoid multiple inlets. By doing so, the function of the regulators can be utilized for both fuel types, but the user cannot choose the wrong inlet for the fuel because there is only one inlet to choose from. This reduces the possibility of user error as compared to the two-inlet systems.

The main control valve 125 acts as a mechanism for permitting the flow of fuel to eventually be combusted. The main control valve includes a solenoid valve 127 that can selectively permit the passage of fuel based on a current actuating a plunger and removing the plunger from an opening. The main control valve 125 therefore selectively permits the fuel to flow to a selector valve outlet 130 and then to a main burner 135 based on the current applied to the solenoid valve 127. The selector valve inlet 115 and outlet 130, along with the other mechanical attributes of the selector valve, can collectively be referred to herein as a selector valve 137.

The solenoid valve 127 acts as a precise and responsive control mechanism for regulating the flow of fuel, such as liquid propane or natural gas. The solenoid valve 127 can include a coil of wire surrounding a movable plunger and can be selectively energized to create a magnetic field, causing the plunger to move and either open or close the valve 127. For example, a thermocouple located proximate a pilot flame can convert heat energy to electrical energy and provide current to the solenoid valve 127 to open, as is well known in the art. This dynamic control allows for instantaneous and accurate modulation of the fuel supply, enhancing the heater's efficiency and responsiveness. Furthermore, the solenoid valve 127 plays a critical role in the overall safety of the heating system by facilitating rapid shut-off in the event of anomalies or emergencies, mitigating potential risks associated with gas flow.

A thermocouple is a temperature-sensing device commonly used in heating appliances, including heaters and furnaces. It operates based on the Seebeck effect, which is the phenomenon where a voltage is generated when two different metals are joined at two different temperatures. In the case of a thermocouple, it typically consists of two dissimilar metal wires joined at one end to form a junction. This junction is exposed to the temperature being measured, while the other ends of the wires are connected to a circuit. When there is a temperature difference between the junction and the connected ends, a voltage is produced in the circuit. This voltage is proportional to the temperature difference and is used to measure and control the temperature of the heating element. In heating appliances and other dual-fuel devices, the thermocouple serves a crucial safety function by acting as a flame sensor-if the flame goes out, the temperature at the thermocouple drops, leading to a loss of voltage and triggering a safety shutdown of the gas supply by foregoing the provision of an electrical current to the solenoid valve. This in turn prevents the release of unburned gas or, in the examples of the presently disclosed embodiments, prevents the passage of the wrong gas to the wrong orifice.

The liquid propane regulator 110 and natural gas regulator 120 can be any conventional regulator for these fuel types. These regulators are devices used in natural gas and liquid propane distribution systems to control the pressure of the gas delivered to appliances and equipment. Natural gas and liquid propane typically flow from high-pressure transmission pipelines to lower-pressure distribution pipelines and then to individual homes, businesses, or industrial facilities. The pressure of the fuel must be reduced at various stages of this distribution process to match the requirements of the end-use applications. These regulators 110, 120 ensure the proper pressure is provided to the system 100 so that the system 100 may function correctly.

The selector valve 137 can be a conventional valve that permits the flow of fuel based on the selection of the user. For example, the user can rotate or otherwise adjust the selector valve 137 to select "Natural Gas" if the user is feeding natural gas into the system 100. In this example, and as shown in FIG. 1, the fuel will be mechanically blocked from passing directly to the main control valve 125 from the selector valve inlet 115. Instead, the fuel will be mechanically directed to the natural gas regulator 120 and then to the main control valve 125.

The selector valve 137 can provide mechanical blockage or direction through any known manner, but in an embodiment, permits the passage of fuel by aligning a pipe in the preferred direction; and prevents the passage of fuel by not aligning a pipe in the preferred direction.

In the example of FIG. 1, the fuel is prevented from flowing from the selector valve 137 to a liquid propane oxygen depletion sensor assembly 140 and its corresponding liquid propane thermocouple 141 because the selector valve 137 is set to the natural gas setting. Instead, the fuel is provided to the gas judgment assembly 145 with its associated ion induction needle 146 and gas judgment assembly oxygen depletion sensor assembly 147 (including, for example, an oxygen depletion sensor and pilot with a nozzle) for determination of whether the fuel is natural gas or liquid propane. Here, fuel flows to a natural gas oxygen depletion sensor assembly 150 and, if a flame is present, heats the natural gas thermocouple 151 to create a current. The natural gas oxygen depletion sensor assembly 150 and the gas judgment assembly 145 can thereafter feed this electrical information to the control system 155 so that the control system 155 may determine what fuel is being fed into the system and, as a result, whether that fuel matches the fuel selected at the selector valve 137.

The natural gas oxygen depletion sensor assembly 150 and the liquid propane oxygen depletion sensor assembly 140 can include any conventional oxygen depletion sensor. These sensors play a pivotal role in ensuring user safety by continuously monitoring the oxygen levels in the surrounding environment during the heating process. The liquid propane oxygen depletion sensor assembly 140 is specifically designed to detect any depletion of oxygen when the heater is fueled by liquid propane, while the natural gas oxygen depletion sensor assembly 150 serves a similar function when the heater, grill, or other product is powered by natural gas. In the event of oxygen levels dropping below a predetermined threshold, these sensors trigger an automatic shut-off mechanism, preventing the risk of oxygen deprivation and potential harm to individuals in the vicinity.

The gas judgment assembly 145 can be any device or electrical circuitry that can ascertain a fuel type, heat amount, or existence of a flame. For example, the gas judgment assembly 145 can include an ion induction needle 146 that senses the flame state (flame or no flame) and provide that information to the control system 155. Alternatively, the ion induction needle 146 can be replaced by any sensor capable of sensing the existence of a flame, herein referred to as a "sensor." The gas judgment assembly oxygen depletion sensor assembly 147 is large enough to permit a flame with liquid propane fuel and its higher pressure, but small enough to prevent a flame with natural gas and its lower pressure. Accordingly, if a flame is present at the gas judgment assembly oxygen depletion sensor assembly 147, that necessarily means the fuel is liquid propane.

The control system 155 can include a relay 160 and a flame database 165 to facilitate the disconnection of electrical current from the various ODS assemblies 140, 150 and the solenoid valve 127 of the main control valve 125. For example, the flame database 165 can temporarily or permanently store the data provided by the gas judgment assembly 145 identifying a flame state, and cause the relay 160 to act or not act based on that determination. That is, the relay 160 is closed be default, to the term "take action" is intended to mean relative to that default setting. The control system 155 can take different actions based on the signals provided by the ion induction needle 146 associated with the gas judgment assembly 145. If the control system 155 determines a flame is present based on the signal from the ion induction needle 146, the control system 155 can take action and disconnect the relay 160, thereby disconnecting the electrical connection to the solenoid valve 127 in the main control valve 125 and preventing the opening of the solenoid valve 127. This prevents the flow of fuel from the main control valve 125 to the selector valve outlet 130 and, eventually, the burner 135. If the ion induction needle 146 does not sense any flame, the relay 160 will remain closed and the solenoid valve 127 will remain electrically connected to the ODS assemblies 140, 150, thereby allowing the passage of fuel beyond the main control valve 125 if the solenoid valve 127 is actuated by an electrical current provided by a thermocouple 141, 151.

FIG. 1 provides an illustrative example of an erroneous fuel selection. As shown, the liquid propane source 105 provides liquid propane fuel into the system 100, which is selected to be receiving natural gas fuel. Recall that natural gas is provided at a lower pressure with a larger nozzle into the burner 135. So, by selecting natural gas at the selector valve 137 when the fuel is really liquid propane, the fuel has a high likelihood of exploding due to the larger nozzle and higher pressure fuel.

In this example, the fuel flows through the liquid propane regulator 110 and through the selector valve inlet 115. The selector valve 137 mechanically prevents the fuel from passing directly to the main control valve 125 because it is set to the natural gas mode, meaning the fuel must pass through the natural gas regulator 120 before reaching the main control valve 125. At the same time, the selector valve 137 mechanically prevents the fuel from traveling to the liquid propane oxygen depletion sensor assembly 140 because the system 100 is set to the natural gas mode.

As shown, the fuel flows to the natural gas oxygen depletion sensor assembly 150 and the gas judgment assembly 145 for determination of what type of fuel is being used as determined by the control system 155. For example, the fuel in this scenario would cause a flame to be ignited at the natural gas oxygen depletion sensor assembly 150 and the gas judgment assembly oxygen depletion sensor assembly 147 and therefore sensed by the ion induction needle 146 of the gas judgment assembly 145. The nozzle of the gas judgment assembly oxygen depletion sensor assembly 147 is sized large enough to permit a flame when the fuel is the higher pressure liquid propane, but small enough to not permit a flame when the fuel is the lower pressure natural gas. Here, the gas judgment assembly 145 would sense the flame because the fed fuel is liquid propane, send a signal to the control system 155 indicating a flame is present, and the control system 155 would optionally store the signal in the flame database 165 and then open the relay 160. In doing so, the relay 160 would disconnect the electrical connection to the solenoid valve 127 within the main control valve 125 and therefore prevent the natural gas thermocouple 151 from providing current to the solenoid valve 127 so as to open the solenoid valve 127. Remaining closed, the solenoid valve 127 would therefore prevent the passage of fuel to the burner 135 and the likely explosion that would ensue.

Figure 2:
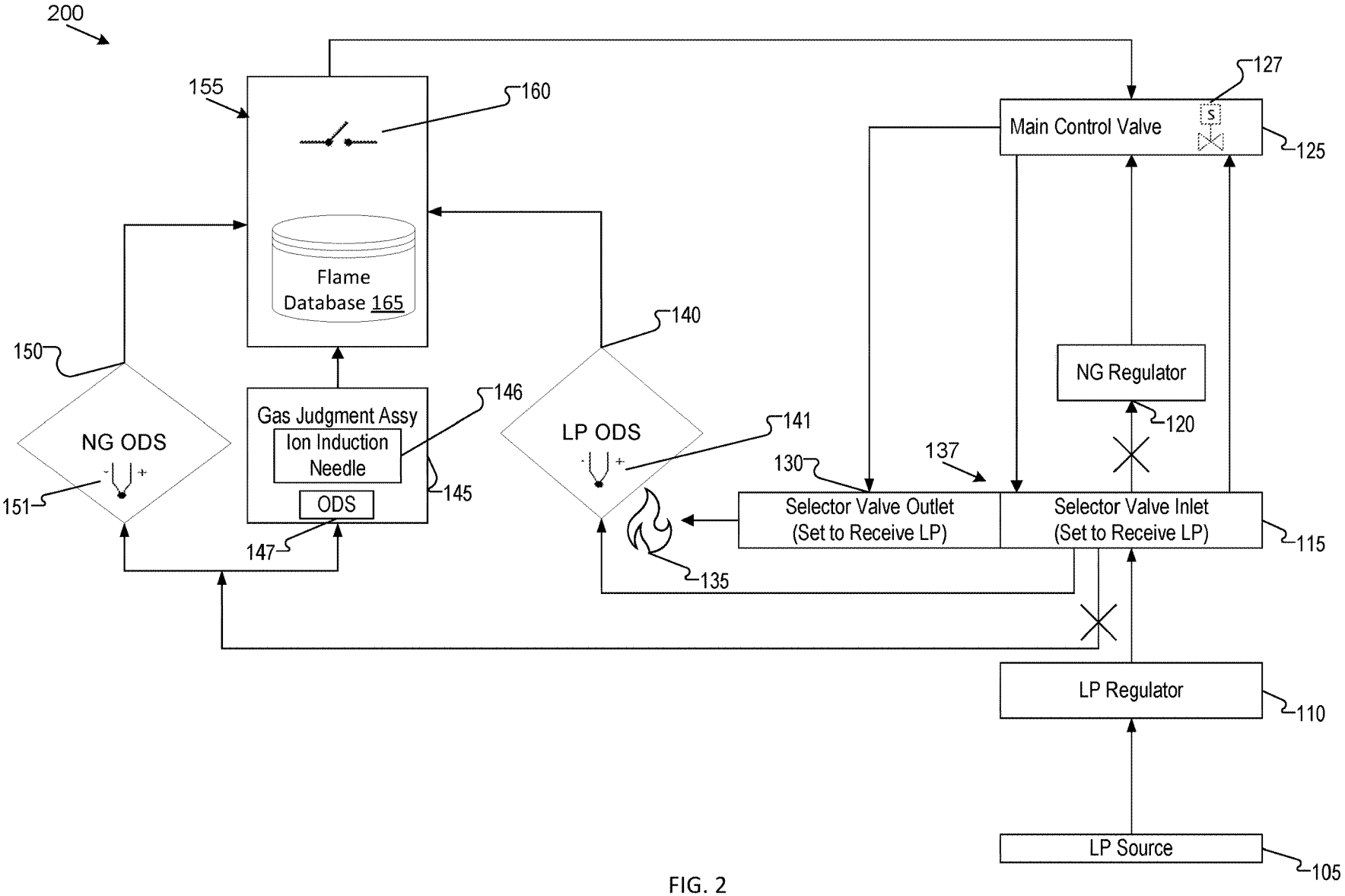
FIG. 2 illustrates a schematic representation of one of the presently disclosed embodiments with the selector valve in the liquid propane setting, and liquid propane fed into the system.

FIG. 2 illustrates a schematic representation of one of the presently disclosed embodiments with the selector valve 137 in the liquid propane setting, and liquid propane fed into the system. As shown, the system 200 includes similar elements as in FIG. 1, and such elements are labeled similarly as a result. However, the system 200 of FIG. 2 differs from that of FIG. 1 in that certain passages are blocked or opened by the selector valve 137 based on the correct selection of liquid propane when liquid propane is being fed into the system 200.

As shown, the liquid propane flows from the liquid propane source 105 through the liquid propane regulator 110 and into the selector valve inlet 115. The selector valve 137 is set to receive liquid propane fuel, so it mechanically directs the liquid propane to the main control valve 125 and also to the liquid propane oxygen depletion sensor assembly 140. The liquid propane oxygen depletion sensor assembly 140 generates a pilot flame based on user actuation of an ignitor, and provides current to the solenoid valve 127 of the main control valve 125 to cause it to open and permit the flow of fuel. Here, the gas judgment assembly 145 will not sense any flame because the selector valve 137 prevents fuel from flowing to the gas judgment assembly 145, as shown. Accordingly, the control system 155 causes the relay 160 to remain in the closed state, permitting electrical connection to the solenoid valve 127 of the main control valve 125 and thus the selective actuation of the solenoid valve 127 to permit the flow of fuel. Once fuel flows through the main control valve 125, it can flow back through the selector valve outlet 130 and to the burner 135 for combustion, or in some embodiments, directly to the burner 135 or through other intermediate elements.

Figure 3:
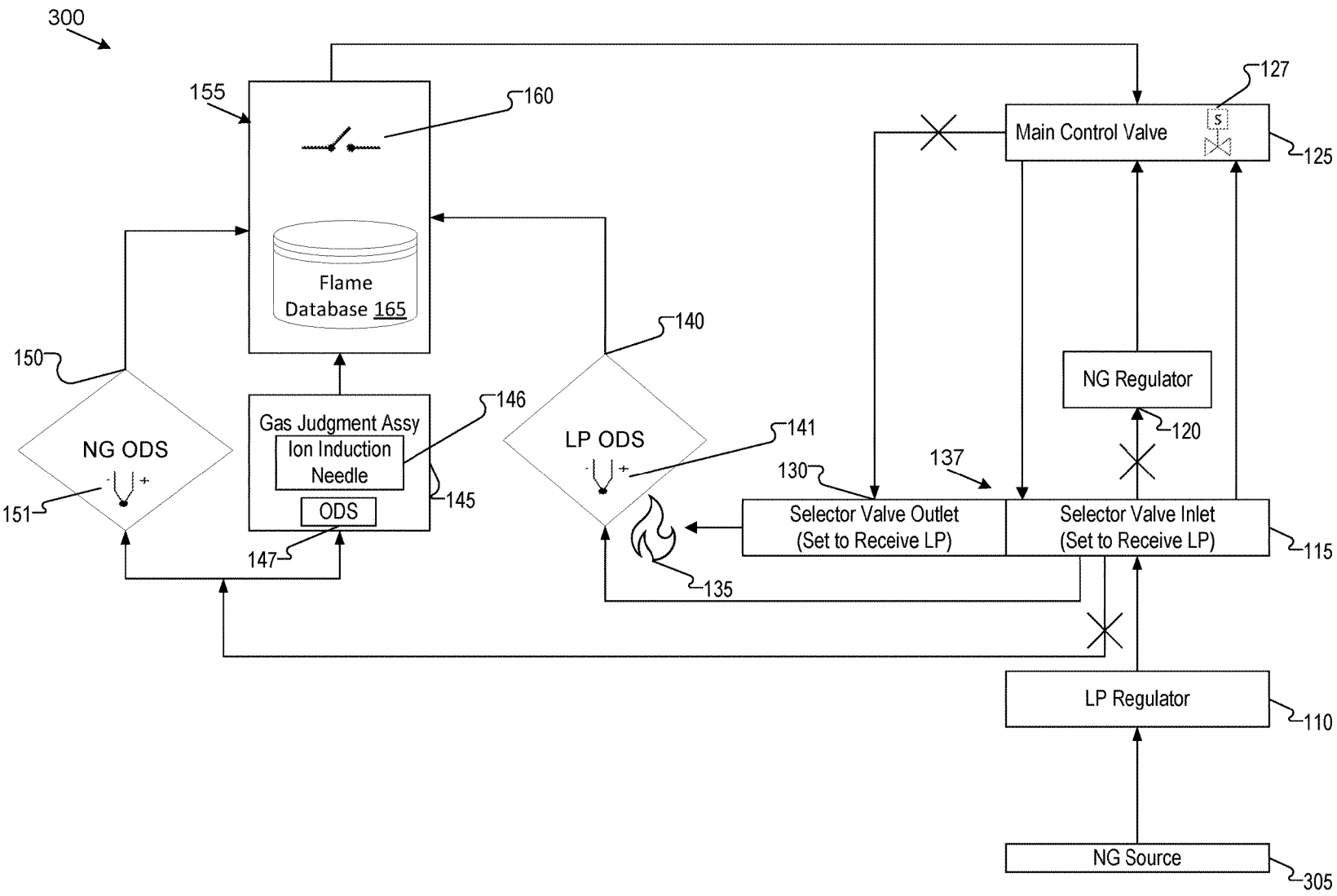
FIG. 3 illustrates a schematic representation of one of the presently disclosed embodiments with the selector valve in the liquid propane setting, and natural gas fed into the system.

FIG. 3 illustrates a schematic representation of one of the presently disclosed embodiments with the selector valve 127 in the liquid propane setting, and natural gas fed into the system. As shown, the system 300 includes similar elements as in FIG. 1, and such elements are labeled similarly as a result. However, the system 300 of FIG. 3 differs from that of FIGS. 1 and 2 in that certain passages are blocked or opened by the selector valve 137 based on the incorrect selection of liquid propane when natural gas is being fed into the system 300.

As shown, the fuel source in FIG. 3 is natural gas, and accordingly, a natural gas source 305 is illustrated. The fuel flows from the natural gas source 305 through the liquid propane regulator 110 first, then through the selector valve inlet 115, and to the main control valve 125. Here, the selector valve 137 is incorrectly set to liquid propane, so the fuel does not pass through the natural gas regulator 120 before reaching the main control valve 125 and is blocked from doing so by the selector valve 137.

The fuel then passes from the main control valve 125 to the liquid propane oxygen depletion sensor assembly 140, optionally passing through intermediary elements such as the selector valve 137. There, the nozzle of the liquid propane oxygen depletion sensor assembly 140 is too small to ignite the natural gas, preventing the formation of any flame and therefore preventing the heating of a thermocouple that would thereafter provide current to a solenoid valve 127 to open. Although fuel will continue to flow, the amount of fuel is minimal because the natural gas has a low pressure and is only being emitted through a small nozzle in the liquid propane oxygen depletion sensor assembly 140. Accordingly, the solenoid valve in the main control valve 125 does not open due to the lack of current from any oxygen depletion sensor assembly 140, 150, and the fuel is blocked from flowing from the main control valve 125 to the burner 135.

Figure 4:
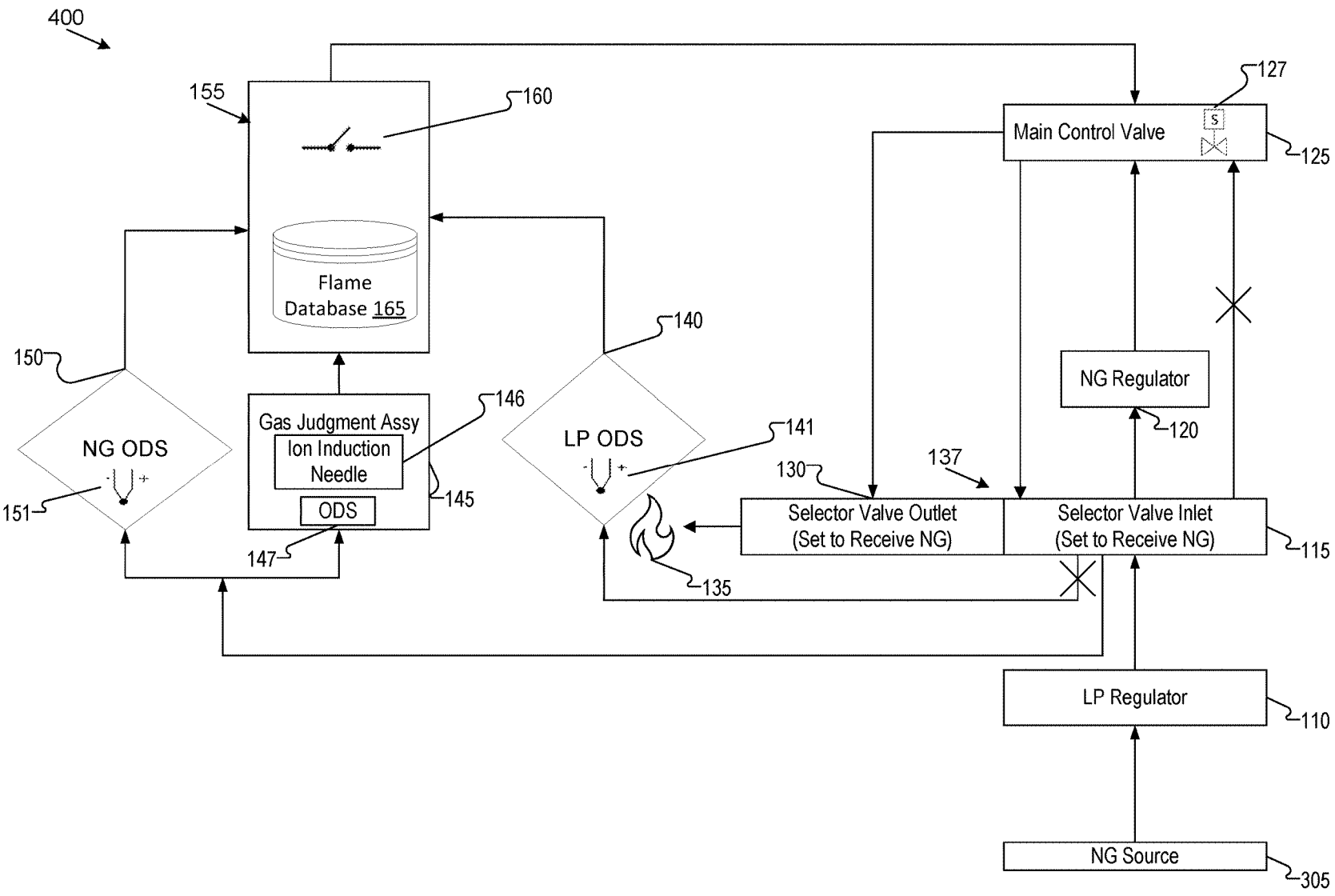
FIG. 4 illustrates a schematic representation of one of the presently disclosed embodiments with the selector valve in the natural gas setting, and natural gas fed into the system.

FIG. 4 illustrates a schematic representation of one of the presently disclosed embodiments with the selector valve in the natural gas setting, and natural gas fed into the system. As shown, the system 400 includes similar elements as in FIGS. 1-3, and such elements are labeled similarly as a result. However, the system 400 of FIG. 4 differs in that certain passages are blocked or opened by the selector valve 137 based on the correct selection of natural gas when natural gas is being fed into the system 400.

As shown, the natural gas source 305 provides fuel through the liquid propane regulator 110 and the selector valve inlet 115. Because the selector valve 137 is correctly set to the natural gas mode, the selector valve 137 can thereafter mechanically direct the gas to the main control valve 125 and the natural gas oxygen depletion sensor assembly 150 and gas judgment assembly 145. The fuel flowing to the natural gas oxygen depletion sensor assembly 150 provides a normal flame, providing current to the solenoid valve 127 to open and therefore cause the main control valve 125 to permit the flow of fuel to the burner 135 via the selector valve outlet 130 or through other paths, including optionally directly providing the fuel to the burner 135. However, the natural gas does not cause a flame at the gas judgment assembly 145 because of the smaller orifice of the gas judgment assembly oxygen depletion sensor assembly 147. Accordingly, the gas judgment assembly 145 does not provide a signal to the control system 155 indicating a flame is present, and therefore the control system 155 does not disconnect the relay 160 so as to disconnect an electric connection to the main control valve 125 and the solenoid valve 127 therein. The natural gas oxygen depletion sensor assembly 150 can therefore provide current to the main control valve 125 and the solenoid valve 127 therein, allowing for the selective passage of natural gas to the burner 135 via the selector valve outlet 130.

Figure 5:
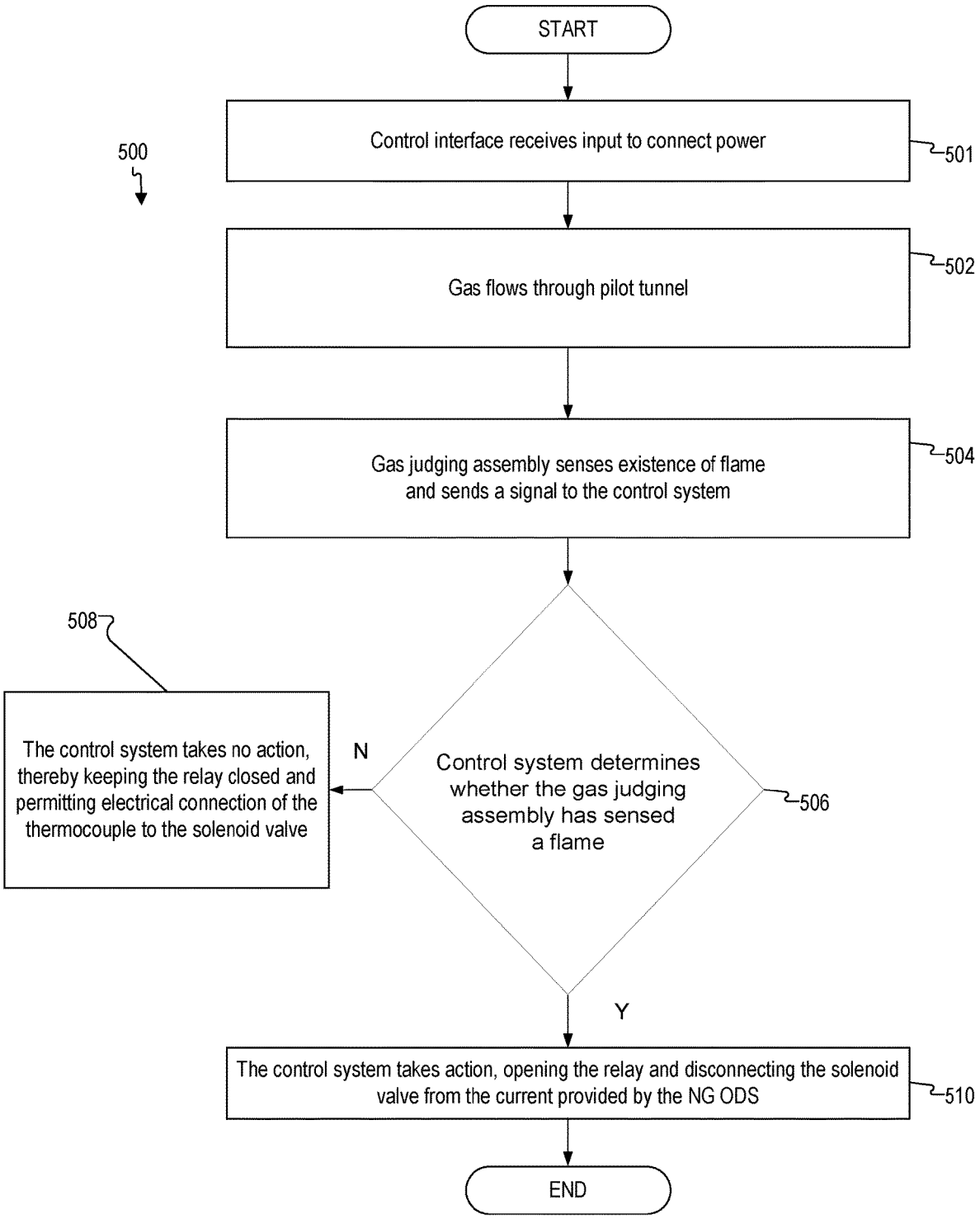
FIG. 5 illustrates a flow chart showing a circuit logic for the control system according to at least some of the presently disclosed embodiments.

FIG. 5 illustrates a flow chart showing a circuit logic for the control system according to at least some of the presently disclosed embodiments. The flow chart in FIG. 5 represents a situation where the valve is in natural gas mode as selected at the selector valve 137. As shown, the process 500 begins and proceeds to step 501 where a control interface receives an input to connect power to the valve. Here, the control interface can be a knob or other element that causes a pilot flame to ignite as is well known in the art.

The process proceeds to step 502, where a gas flows through the pilot tunnel based on the direction of the selector valve 137. The gas judging assembly 145 then senses the existence of a flame and sends a signal to the control system 155 in step 504. The control system 155 determines whether the gas judging assembly 145 has sensed a flame in step 506. If so, the control system takes action from its default closed relay 160 mode and opens the relay 160 to thereby disconnect the solenoid valve 127 from the current provided by the natural gas oxygen depletion sensor assembly 150 in step 510. If not, the control system 155 takes no action, thereby keeping the relay 160 in its closed position and permitting the electrical connection of the natural gas thermocouple 151 to the solenoid valve 127 to thereby open the solenoid valve 127 and allow fuel to flow to the burner 135 in step 508. Following steps 508 and 510, the process 500 ends.

Figure 6:
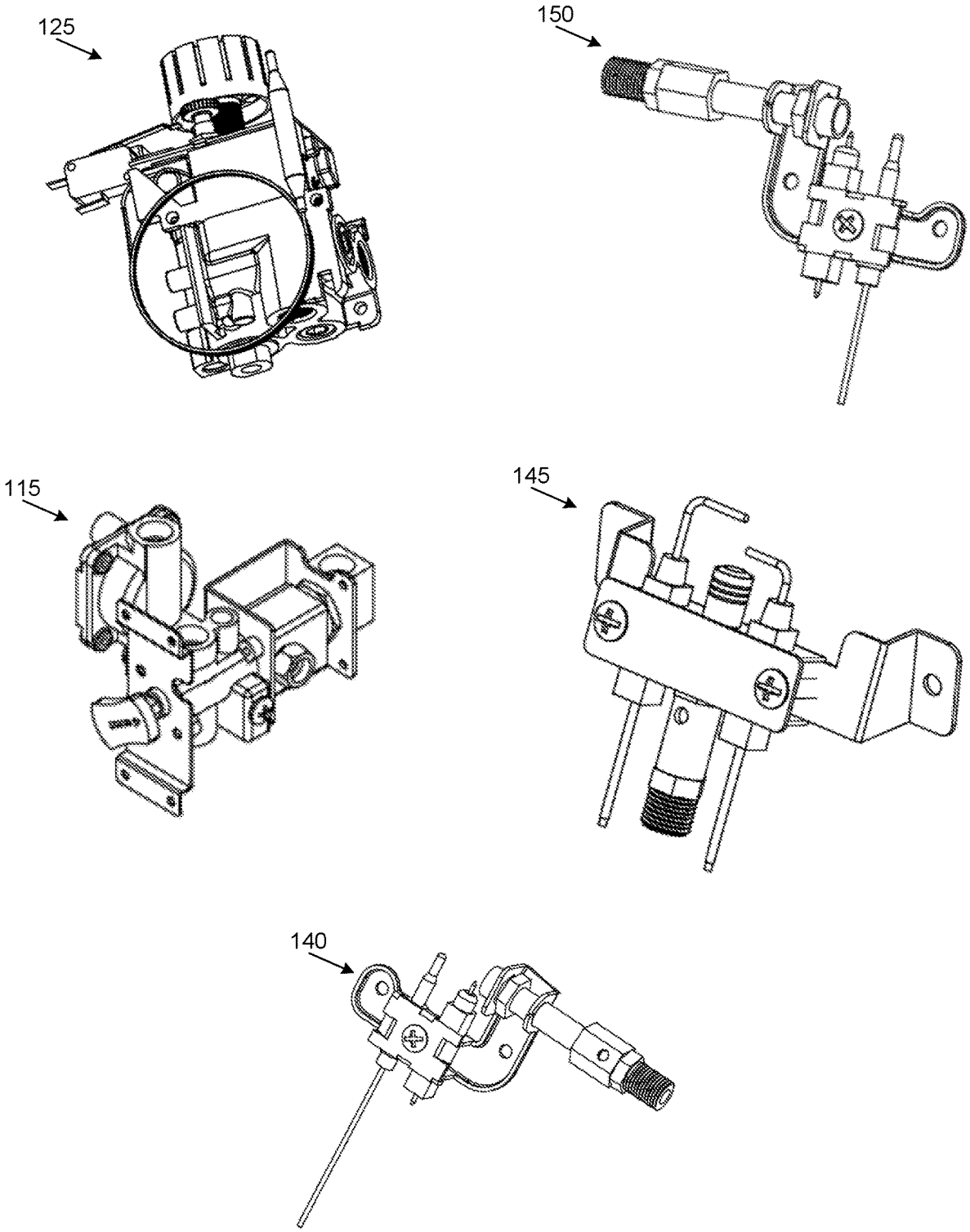
FIG. 6 illustrates example individual components of the dual fuel valve according to at least some of the presently disclosed embodiments.

FIG. 6 illustrates example individual components of the dual fuel valve according to at least some of the presently disclosed embodiments. The structures of the main control valve 125, natural gas oxygen depletion sensor assembly 150, selector valve 115, gas judgment assembly 145, and liquid propane oxygen depletion sensor assembly 140 can be structured as shown in FIG. 6. Alternative structures providing the same function as that discussed above can also be implemented without departing from the spirit and scope of the present invention.

As used herein, the term "LP" is intended to act as shorthand for the fuel liquid propane, and the term "NG" is intended to act as shorthand for natural gas. Although embodiments have been described in detail for purposes of illustration, various modifications may be made without departing from the scope and spirit of the present disclosure.

Accordingly, the disclosure is not to be limited by the examples presented herein but is envisioned as encompassing the scope described in the appended claims and the full range of equivalents of the appended claims. The detailed description and drawings are merely illustrative of the present disclosure rather than limiting, the scope of the present disclosure being defined by the appended claims and equivalents thereof.

Benefits, other advantages, and solutions to problems have been described herein with regard to specific embodiments. However, the benefits, advantages, solutions to problems, and elements that may cause any benefit, advantage, or solution to occur or become more pronounced are not to be construed as critical, required, or essential features or elements of the disclosure.

As used herein, the term "coupled" and its functional equivalents are not intended to necessarily be limited to direct, mechanical coupling of two or more components. Instead, the term "coupled" and its functional equivalents are intended to mean any direct or indirect mechanical, electrical, or chemical connection between two or more objects, features, work pieces, and/or environmental matter. "Coupled" is also intended to mean, in some examples, one object being integral with another object.

Further, it should be appreciated that in the appended claims, reference to an element in the singular is not intended to mean "one and only one" unless explicitly so stated, but rather "one or more."

The description of the disclosure is provided to enable any person skilled in the art to make or use the disclosure. Various modifications to the disclosure will be readily apparent to those skilled in the art, and the generic principles defined herein may be applied to other variations without departing from the spirit or scope of the disclosure. Thus, the disclosure is not intended to be limited to the examples and designs described herein but is to be accorded the widest scope consistent with the principles and novel features disclosed herein.

The words "illustrative" or "exemplary" are used herein to mean "serving as an example, instance, or illustration." Any aspect described herein as "illustrative" or "exemplary" is not necessarily to be construed as preferred or advantageous over other aspects.

As used herein, a phrase referring to "at least one of" a list of items refers to any combination of those items, including single members. As an example, "at least one of: a, b, or c" is intended to cover: a, b, c, a-b, a-c, b-c, and a-b-c.

The methods disclosed herein comprise one or more steps or actions for achieving the described method. The method steps and/or actions may be interchanged with one another without departing from the scope of the claims. In other words, unless a specific order of steps or actions is specified, the order and/or use of specific steps and/or actions may be modified without departing from the scope of the claims.

Aspect 1. A valve system comprising: a gas judgment assembly including a nozzle sized to permit an existence of a flame when liquid propane flows through the nozzle, but prevent the existence of the flame when natural gas flows through the nozzle, and further configured to sense the existence of the flame with a sensor; a natural gas thermocouple configured to provide electrical current when heated; a solenoid valve electrically coupleable to the natural gas thermocouple and configured to open and allow the passage of fuel when provided with the electrical current, and remain closed when not provided with the electrical current; and a control system electrically coupled to the gas judgment assembly and including a relay configured to remain in a closed state absent a signal from the gas judgment assembly indicating the existence of a flame, and further configured to open the relay when the control system receives the signal from the gas judgment assembly, wherein the relay electrically couples the natural gas thermocouple to the solenoid valve when closed, and electrically disconnects the natural gas thermocouple to the solenoid valve when opened.

Aspect 2. The valve system of Aspect 1, further comprising: a natural gas regulator upstream of the solenoid valve; a liquid propane regulator upstream of the natural gas regulator, and configured to accept a fuel source.

Aspect 3. The valve system of any of Aspects 1 to 2, further comprising: a selector valve selectable to one of a liquid propane setting and a natural gas setting, where the selector valve directs the fuel based on a selection thereof.

Aspect 4. The valve system of any of Aspects 1 to 3, further comprising a liquid propane thermocouple electrically coupled to the control system and operable to provide a current to the control system when heated, wherein the selector valve directs the fuel to the liquid propane thermocouple when in the liquid propane setting.

Aspect 5. The valve system of any of Aspects 1 to 4, wherein the solenoid valve directs the fuel to a burner for combustion via the selector valve.

Aspect 6. The valve system of any of Aspects 1 to 5, wherein the sensor is an ion induction needle.

Aspect 7. The valve system of any of Aspects 1 to 6, further comprising a flame database associated with the control system and configured to store data indicating the existence of a flame.

Aspect 8. A method of controlling a flow of fuel comprising: receiving the fuel at a gas judgment assembly including a nozzle sized to permit an existence of a flame when liquid propane flows through the nozzle, but prevent the existence of the flame when natural gas flows through the nozzle, and further configured to sense the existence of the flame with a sensor; providing an electrical current by a natural gas thermocouple when heated; receiving the electrical current at a solenoid valve electrically coupleable to the natural gas thermocouple, the solenoid valve configured to open and allow the passage of fuel when provided with the electrical current, and remain closed when not provided with the electrical current; and controlling a relay by a control system electrically coupled to the gas judgment assembly, the control system configured to keep the relay in a closed state absent a signal from the gas judgment assembly indicating the existence of a flame, and further configured to open the relay when the control system receives the signal from the gas judgment assembly, wherein the relay electrically couples the natural gas thermocouple to the solenoid valve when closed, and electrically disconnects the natural gas thermocouple to the solenoid valve when opened.

Aspect 9. The method of Aspect 8, further comprising: connecting a fuel source to a liquid propane regulator; and passing the fuel through the liquid propane regulator prior to passing the fuel through a natural gas regulator upstream of the solenoid valve.

Aspect 10. The method of any of Aspects 8 to 9, further comprising where the selector valve directs the fuel based on a selection thereof.

Aspect 11. The method of any of Aspects 8 to 10, further comprising providing a current to the control system from a liquid propane thermocouple electrically coupled to the control system, wherein the selector valve directs the fuel to the liquid propane thermocouple when in the liquid propane setting.

Aspect 12. The method of any of Aspects 8 to 11, further comprising directing the fuel from the solenoid valve to a burner for combustion via the selector valve.

Aspect 13. The method of any of Aspects 8 to 12, wherein the sensor is an ion induction needle.

Aspect 14. The method of any of Aspects 8 to 13, further comprising storing data indicating the existence of a flame in a flame database associated with the control system.

Aspect 15. A valve system comprising: a gas judgment assembly including a nozzle sized to permit an existence of a flame when liquid propane flows through the nozzle, but prevent the existence of the flame when natural gas flows through the nozzle, and further configured to sense the existence of the flame with a sensor; and a control system electrically coupled to the gas judgment assembly and including a relay configured to remain in a closed state absent a signal from the gas judgment assembly indicating the existence of a flame, and further configured to open the relay when the control system receives the signal from the gas judgment assembly.

Aspect 16. The valve system of Aspect 15, further comprising: a solenoid valve electrically coupled to the relay; a natural gas regulator upstream of the solenoid valve; and a liquid propane regulator upstream of the natural gas regulator, and configured to accept a fuel source.

Aspect 17. The valve system of any of Aspects 15 to 16, further comprising: a selector valve selectable to one of a liquid propane setting and a natural gas setting, where the selector valve directs the fuel based on a selection thereof.

Aspect 18. The valve system of any of Aspects 15 to 17, wherein the sensor is an ion induction needle.

Aspect 19. The valve system of any of Aspects 15 to 18, further comprising a thermocouple electrically coupled to the control system and operable to provide a current to the control system when heated.

Aspect 20. The valve system of any of Aspects 15 to 19, wherein the relay is configured to electrically couple or decouple the thermocouple to a solenoid valve based on the signal from the gas judgment assembly.

What is claimed is:

1. A valve system comprising:

a gas judgment assembly including a nozzle sized to permit an existence of a flame when liquid propane flows through the nozzle, but prevent the existence of the flame when natural gas flows through the nozzle, and further configured to sense the existence of the flame with a sensor;

a natural gas thermocouple configured to provide electrical current when heated;

a solenoid valve electrically coupleable to the natural gas thermocouple and configured to open and allow a passage of fuel when provided with the electrical current, and remain closed when not provided with the electrical current; and a control system electrically coupled to the gas judgment assembly and including a relay configured to remain in a closed state absent a signal from the gas judgment assembly indicating the existence of a flame, and further configured to open the relay when the control system receives the signal from the gas judgment assembly, wherein the relay electrically couples the natural gas thermocouple to the solenoid valve when closed, and electrically disconnects the natural gas thermocouple to the solenoid valve when opened.

2. The valve system of claim 1, further comprising:

a natural gas regulator upstream of the solenoid valve; and a liquid propane regulator upstream of the natural gas regulator, and configured to accept a fuel source.

3. The valve system of claim 1, further comprising:

a selector valve selectable to one of a liquid propane setting and a natural gas setting, where the selector valve directs the fuel based on a selection thereof.

4. The valve system of claim 1, wherein the sensor is an ion induction needle.

5. The valve system of claim 3, further comprising a liquid propane thermocouple electrically coupled to the control system and operable to provide a current to the control system when heated, wherein the selector valve directs the fuel to the liquid propane thermocouple when in the liquid propane setting.

6. The valve system of claim 3, wherein the solenoid valve directs the fuel to a burner for combustion via the selector valve.

7. The valve system of claim 1, further comprising a flame database associated with the control system and configured to store data indicating the existence of a flame.

8. A method of controlling a flow of fuel comprising:

receiving the fuel at a gas judgment assembly including a nozzle sized to permit an existence of a flame when liquid propane flows through the nozzle, but prevent the existence of the flame when natural gas flows through the nozzle, and further configured to sense the existence of the flame with a sensor;

providing an electrical current by a natural gas thermocouple when heated;

receiving the electrical current at a solenoid valve electrically coupleable to the natural gas thermocouple, the solenoid valve configured to open and allow a passage of fuel when provided with the electrical current, and remain closed when not provided with the electrical current; and controlling a relay by a control system electrically coupled to the gas judgment assembly, the control system configured to keep the relay in a closed state absent a signal from the gas judgment assembly indicating the existence of a flame, and further configured to open the relay when the control system receives the signal from the gas judgment assembly, wherein the relay electrically couples the natural gas thermocouple to the solenoid valve when closed, and electrically disconnects the natural gas thermocouple to the solenoid valve when opened.

9. The method of claim 8, further comprising:

connecting a fuel source to a liquid propane regulator; and passing the fuel through the liquid propane regulator prior to passing the fuel through a natural gas regulator upstream of the solenoid valve.

10. The method of claim 8, further comprising selecting a selector valve to one of a liquid propane setting and a natural gas setting, where the selector valve directs the fuel based on a selection thereof.

11. The method of claim 8, wherein the sensor is an ion induction needle.

12. The method of claim 10, further comprising providing a current to the control system from a liquid propane thermocouple electrically coupled to the control system, wherein the selector valve directs the fuel to the liquid propane thermocouple when in the liquid propane setting.

13. The method of claim 10, further comprising directing the fuel from the solenoid valve to a burner for combustion via the selector valve.

14. The method of claim 8, further comprising storing data indicating the existence of a flame in a flame database associated with the control system.

15. A valve system comprising:

a gas judgment assembly including a nozzle sized to permit an existence of a flame when liquid propane flows through the nozzle, but prevent the existence of the flame when natural gas flows through the nozzle, and further configured to sense the existence of the flame with a sensor; and a control system electrically coupled to the gas judgment assembly and including a relay configured to remain in a closed state absent a signal from the gas judgment assembly indicating the existence of a flame, and further configured to open the relay when the control system receives the signal from the gas judgment assembly.

16. The valve system of claim 15, further comprising:

a solenoid valve electrically coupled to the relay;

a natural gas regulator upstream of the solenoid valve; and a liquid propane regulator upstream of the natural gas regulator, and configured to accept a fuel source.

17. The valve system of claim 15, further comprising:

a selector valve selectable to one of a liquid propane setting and a natural gas setting, where the selector valve directs fuel based on a selection thereof.

18. The valve system of claim 15, wherein the sensor is an ion induction needle.

19. The valve system of claim 15, further comprising a thermocouple electrically coupled to the control system and operable to provide a current to the control system when heated.

20. The valve system of claim 19, wherein the relay is configured to electrically couple or decouple the thermocouple to a solenoid valve based on the signal from the gas judgment assembly.

* * * * *